United States Patent [19]

McLellan et al.

[11] Patent Number: 4,822,028

[45] Date of Patent: Apr. 18, 1989

[54] PORTABLE EXERCISE DEVICE

[76] Inventors: James N. McLellan, 911 Murfreesboro Rd., Franklin, Tenn. 37064; Lawrence J. Morgan, 317 Willard Dr., Nashville, Tenn. 37211

[21] Appl. No.: 215,367

[22] Filed: Jul. 5, 1988

[51] Int. Cl.[4] ..... A63B 5/00; A63B 21/00

[52] U.S. Cl. ..... 272/67; 272/131; 272/135

[58] Field of Search ..... 272/67, 68, 131, 132, 272/141, DIG. 4, 135, 130, 137, 143, 116, 125, 96, 97, 93; 128/26

[56] References Cited

U.S. PATENT DOCUMENTS 3,971,255 7/1976 Varney et al. ..... 272/143
4,385,760 5/1983 Mattox et al. ..... 272/131
4,613,130 9/1986 Watson ..... 272/68
4,691,915 9/1987 Sutton ..... 272/68

*Primary Examiner*—Richard J. Apley
*Assistant Examiner*—S. R. Crow
*Attorney, Agent, or Firm*—Mark J. Patterson

[57] ABSTRACT

A portable exercise device has a frame which is adapted for the sliding linear motion of plates attached to opposed hand grips. First and second opposed wedges are mounted within the frame, one of which is moved linearly to adjust the compression of perpendicular oriented springs within each of the hand grips. Corresponding slot and pin means are used to prevent linear movement of the hand grips if inadequate perpendicular force is applied. In operation, the device provides both isometric and isotonic exercise.

4 Claims, 4 Drawing Sheets

PORTABLE EXERCISE DEVICE

BACKGROUND OF THE INVENTION

The present invention pertains to portable exercise devices and specifically to portable devices for simultaneous isotonic and isometric exercise of major body muscle groups.

Interest in physical fitness and conditioning activities has increased dramatically in recent years. A particular emphasis has developed on portable exercise equipment which would allow the user to engage in fitness exercises almost anywhere. Examples of such devices are described in U.S. Pat. Nos. 4,580,778; 4,290,600; 4,290,599; 4,239,212; 4,211,405; 3,971,255; 3,834,697; and 3,746,339.

Unfortunately, the prior art portable exercise devices are subject to a number of deficiencies. Many are too bulky and heavy to be considered truly portable. Others are too complicated, requiring a complex assembly of springs and related components. Some, because of the use of springs as the primary tension device, do not provide a constant resistance to effort to the user over the full range of motion of the device. Most of the previously known exercise devices are not easily adjustable in terms of required effort, nor do they provide a simple means of alerting the user that inadequate force is being applied to achieve optimum fitness benefits. Finally, the prior art portable exercise devices do not allow the user to simultaneously engage in isotonic and isometric exercises.

What is needed, then, is a portable exercise device which is compact and lightweight, which is simple in construction, adjustment, and operation, which alerts the user when inadequate effort is being employed, and which allows for both isotonic and isometric exercise of major muscles of the body.

SUMMARY OF THE INVENTION

The present invention overcomes the drawbacks of the prior art by providing opposed hand grips slidably mounted in a lightweight frame. Adjustable compression springs within each handgrip apply force perpendicular to respective opposed wedges fixed centrally within the frame. A handle and activator means linearly adjusts one of the wedges, causing flexion of both wedges and thereby compressing the springs. Slots and pins positioned along the frame channels and sliding plates of the hand grip lock the hand grips if inadequate force is applied by the user in the plane perpendicular to the plane of motion. The device can be used in almost any environment, such as while watching television, sitting in traffic, while flying, et cetera.

DESCRIPTION OF THE PREFERRED EMBODIMENT

Figure 1:
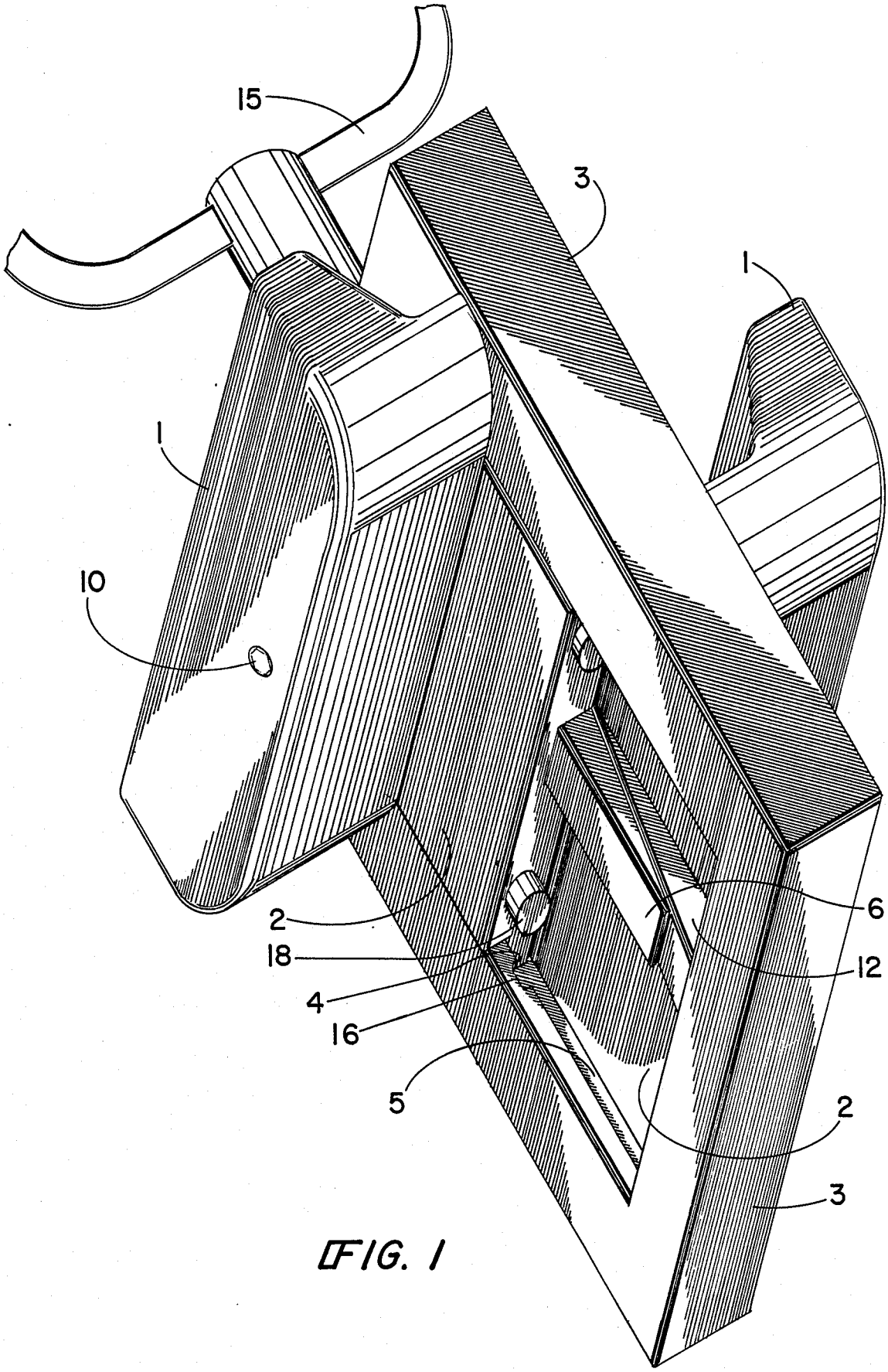
FIG. 1 is an isometric view of the portable exercise device.
Figure 2:
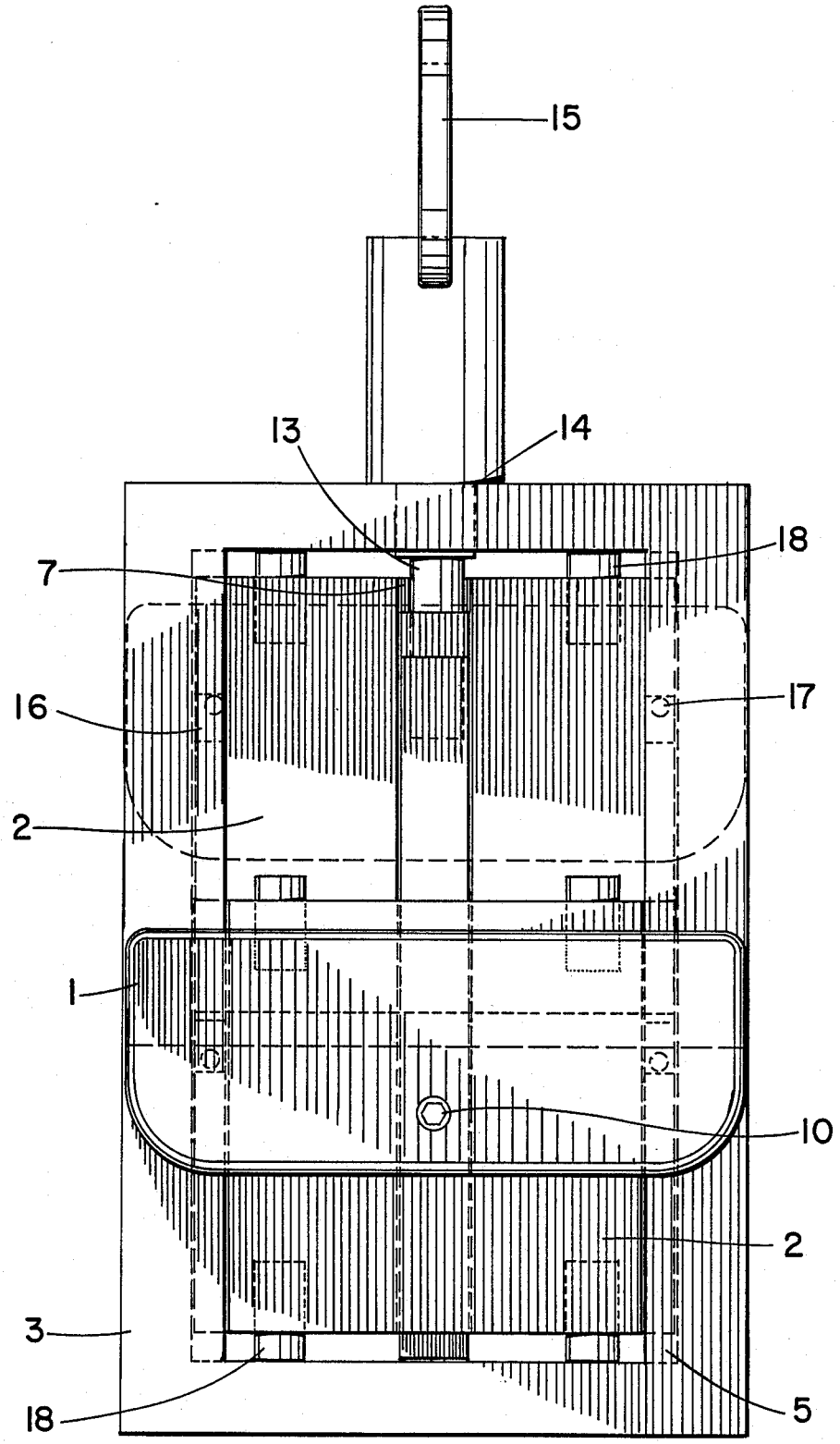
FIG. 2 is a phantom front view of the portable exercise device.
Figure 3:
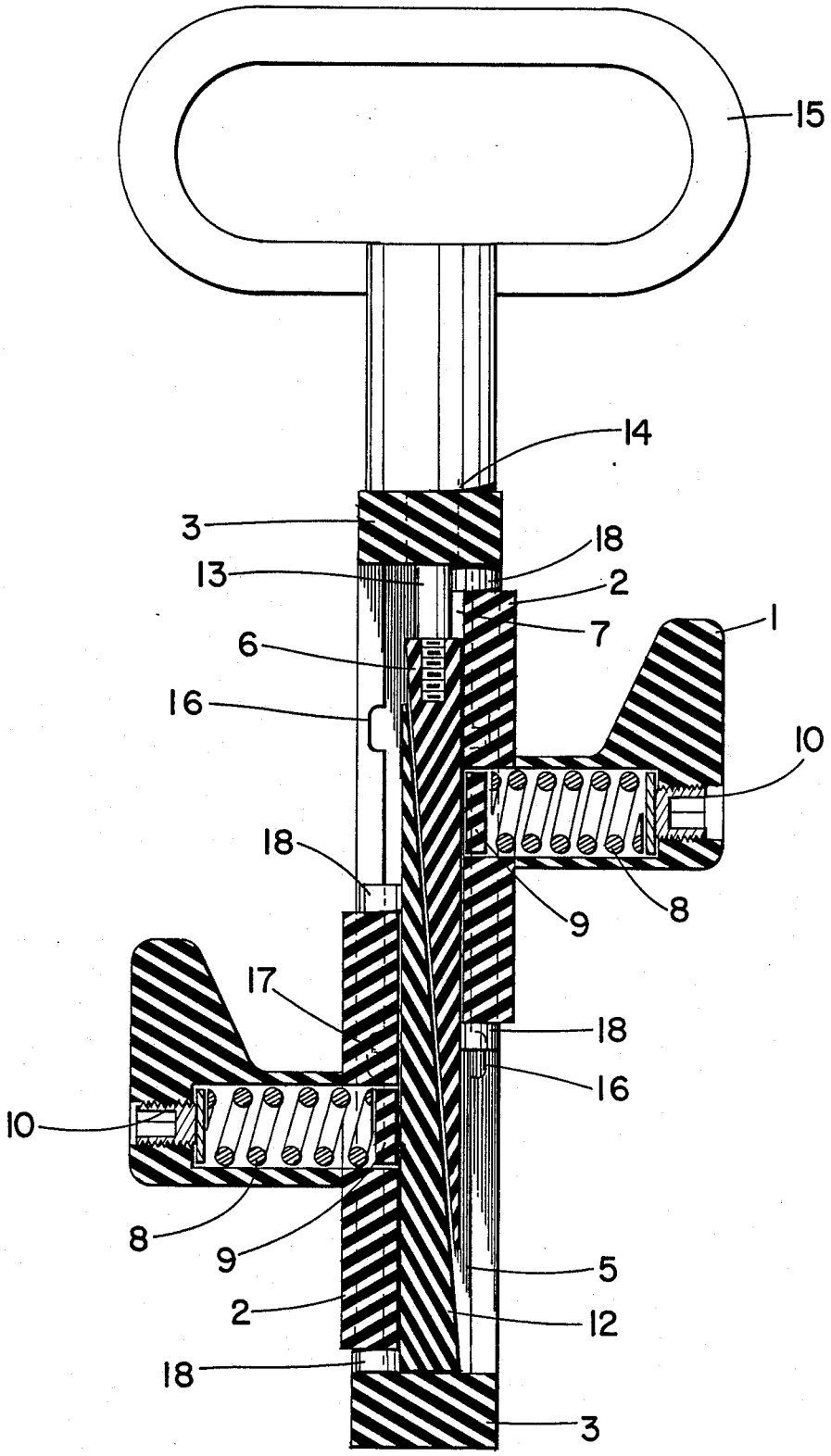
FIG. 3 is a phantom side sectional view of the portable exercise device.
Figure 4:
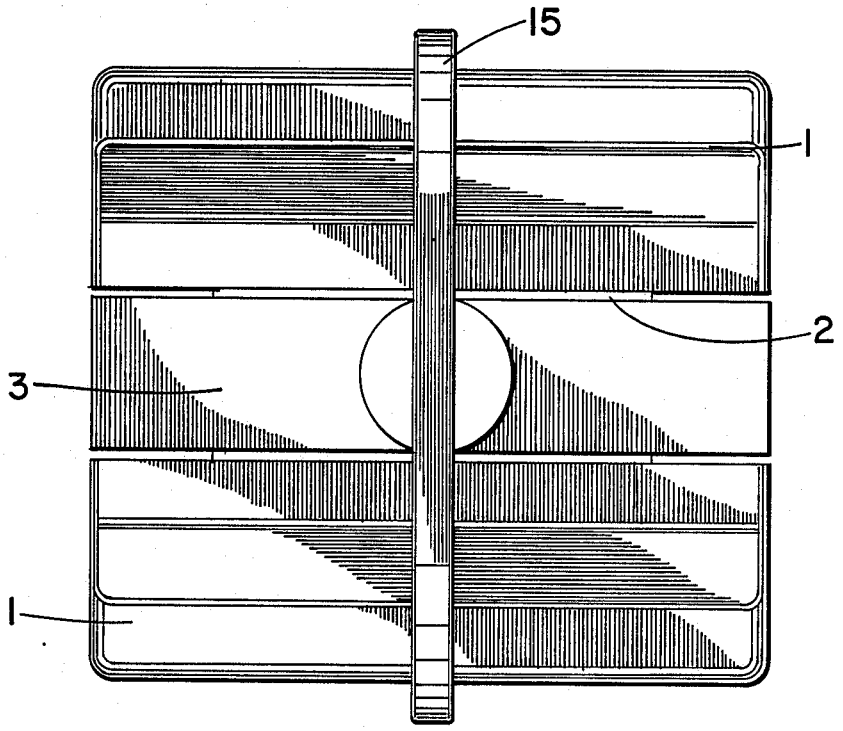
FIG. 4 is an end view of the portable exercise device.

As seen best in FIGS. 1, 2 and 3, a portable exercise device has first and second hand grips 1 attached to opposed first and second slide plates 2. Slide plates 2 are slidably mounted within frame 3. Plates 2 are held within frame 3, as best seen in FIG. 1, by upper and lower splines 4 of plates 2 which slidably fit within channels 5 of frame 3. The combined widths of splines 4 are less than the total width of U-shaped channel 5 so that each of splines 4 may slide linearly within channel 5 and frame 3 without interference.

Centrally and linearly aligned within frame 3 are opposed wedge-shaped first and second tension wedges 6 and 12. Each of plates 2 are provided with notches 7 which surround and permit movement of plates 2 over wedges 6 and 12. Centrally mounted within hand grips 1 and plates 2, and perpendicular to wedges 6 and 12, are compression springs 8 which bear on wedges 6 and 12 through low friction pads 9. The upper or lower limit of compression of springs 8 can be adjusted by set screws 10 which are accessible through corresponding openings through hand grips 1.

First tension wedge 6 is mounted to frame 3 by stud 13 which, in turn, is connected to linear actuator 14 such that when handle 15 is rotated, stud 13 and wedge 6 move linearly in parallel with frame 3 and wedge 12. Second wedge 12 is fixed to frame 3 opposite from the point of connection of first wedge 6. The tapered ends of wedges 6 and 12 are restrained laterally by the corresponding interior surfaces of notches 7. However, flexion of wedges 6 and 12 is only partially restrained by their respective opposed surfaces and by the action of springs 8 through pads 9. Wedges 6 and 12 are made of a hard yet smooth, flexible material such as polypropylene. Pads 9 are made of plastic or other material which will slide easily along the outward facing surfaces of wedges 6 and 12 while transmitting the forces of springs 8.

Thus, rotation of handle 15 will cause linear movement of wedge 6, which in turn slides along the inward facing tapered surface of wedge 12. The result is that, looking at FIG. 3, downward adjustment of wedge 6 will increase compression of springs 8, and upward adjustment of wedge 6 will decrease compression of springs 8.

Located at each end of and in the opposed surfaces of channels 5, are slots 16 which correspond in size to sliding bearing pins 17 located at each end of the outward facing surfaces of splines 4. It can be seen that springs 8 will bias, through contact with pads 9, plates 2 away from wedges 6 and 12, forcing bearing pin 17 against the inward facing surfaces of channels 5. When hand grips 1 and plates 2 reach their limits of travel linearly along frame 3 and within channels 5, bearing pins 17 will engage slots 16, if the user is employing inadequate force to overcome the opposed forces of springs 8. Thus, the user is immediately alerted to the fact that optimum effort is not being utilized.

Bumpers 18, made of rubber or other resilient material, control the impact of plates 2 against frames 3 at the limits of linear travel.

Preferably, hand grips 1, plates 2, frames 3, and handle 15 are made of a durable, light weight, yet strong plastic such as polypropylene. Hand grips 1 should be rounded, relatively L-shaped, and sized to accommodate the hand of the user. It has been found that if frame 3 is approximately 4.5 inches by 5 inches with linear range of motion of hand grips 1 of about 2.5 inches along the greater dimension of frame 3, the entire unit is compact enough to take and use anywhere, yet will give a substantial workout of most muscle groups of the body.

Figure 5:
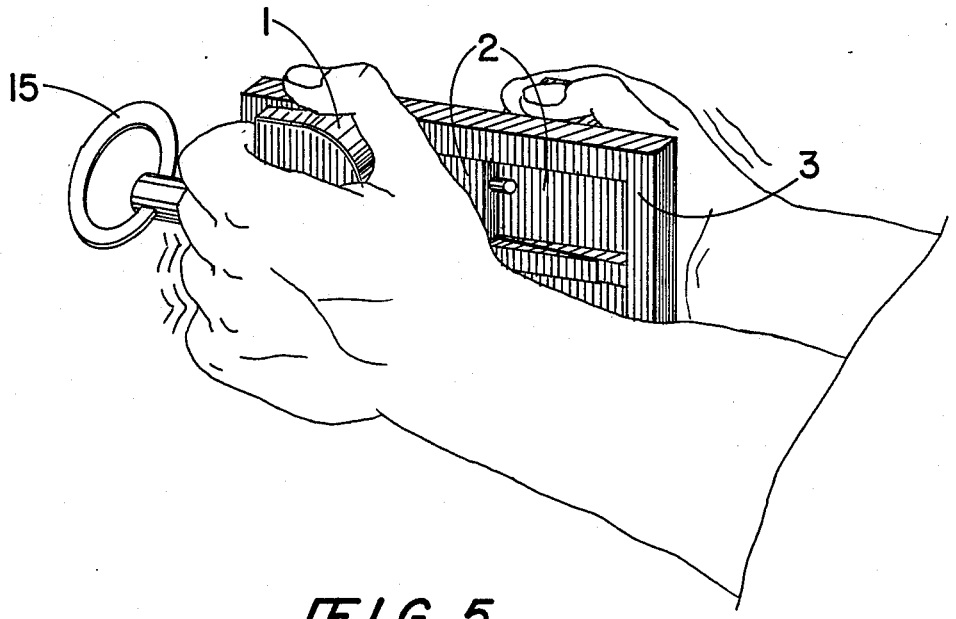
FIG. 5 is a view of the exercise device as typically used.

As seen on FIG. 5, the portable exercise device can be held by the user with arms extended at the desired angle away from the user's body. The heels of the hand should touch the outside surface of plates 2 with the thumbs over and the fingers wrapped around hand grips 1. The user, after having adjusted handle 15 to the desired effort level, presses inward on hand grips 1. He then moves hand grips 1 linearly in opposite directions, pulling on one while pushing on the other. Accordingly, the user is engaged in simultaneous isometric and isotonic exercise. If, during linear movement of hand grips 1 the bearing pins 17 engage slots 16, the user is immediately reminded to increase his effort perpendicular to the plane of motion. By varying the position of the device with respect to the user's body, different sets of muscles can be exercised.

It should be apparent that modifications to the described embodiment can be made without departing from the scope of the invention as claimed. For example, a variety of force resisting means, such as hydraulic cylinders, could be used in place of springs 8. Also, hand grips 1 could be modified, with proportionate changes in other components, to allow for foot operation of the device.

What we claim is:

1. A portable exercise device comprising:

(a) frame means including linear slide channels;

(b) first and second plate means adapted for sliding linearly within said slide channels in said frame means;

(c) grips attached to said plate means, said grips adapted for operative engagement by the user of said portable exercise device;

(d) first and second spring means for resisting inwardly directed efforts of the user of said exercise device, said effort and resistance being directed perpendicular to the direction of travel of said plate means in said linear slide channels;

(e) first and second opposed and abutting flexible wedge means attached to and within said frame means, said first wedge means adapted for slidable linear movement within said frame means and generally parallel with the movement of said plate means, said first and second wedge means having their respective outside surfaces in slidable engagement with friction means attached to said spring means, whereby linear movement of said first wedge means will vary the perpendicular resistance offered by each of said spring means;

(f) actuator means for varying the linear position of said first wedge means, whereby adjustment of said actuator means will vary the resistance of each of said grips to inward force applied by the user of said portable exercise device;

(g) said first and second plate means adapted for slidable engagement by said friction means with said first and second wedge means to provide resistance in a linear direction; and (h) whereby said device provides resistance to both linear and inward movement of said grips.

2. The portable exercise device of claim 1 further comprising stop means for preventing movement of said grips and said plate means along said linear channels when the perpendicular inward force applied to said grips by the user of said portable exercise device is less than that preset by said actuator means.

3. The portable exercise device of claim 2 where said stop means comprises pins attached to said plate means, and corresponding slots within said frame means, wherein said pins engage said slots to prevent linear movement of said plate means within said frame means when the user of said device fails to overcome the perpendicular resistance of said spring means.

4. The portable exercise device of claim 1 wherein said spring means are mounted within said grip and through said plate means, said spring means adapted for resisting force applied perpendicular to the direction of linear movement of said plate means within said frame means, thereby biasing said plate means against the outside surface of said slide channels.

* * * * *